US005926669A

United States Patent [19]

Sugimoto et al.

[11] Patent Number: 5,926,669

[45] Date of Patent: Jul. 20, 1999

[54] IMAGE FORMING APPARATUS AND METHOD OF FORMING AN IMAGE WITH ENHANCED TRANSFER CONDITION SETTINGS

[75] Inventors: Hiroyuki Sugimoto, Kawasaki; Naoko Iwata, Tokyo, both of Japan

[73] Assignee: Ricoh Company, Ltd., Tokyo, Japan

[21] Appl. No.: 08/906,210

[22] Filed: Aug. 5, 1997

[30] Foreign Application Priority Data

Aug. 6, 1996 [JP] Japan ..... 8-206699

[51] Int. Cl.[6] ..... G03G 15/00

[52] U.S. Cl. ..... 399/66

[58] Field of Search ..... 399/49, 66, 72

[56] References Cited

U.S. PATENT DOCUMENTS 5,278,613 1/1994 Bisaiji et al. ..... 399/66
5,296,903 3/1994 Suzuki et al. ..... 399/66
5,510,886 4/1996 Sugimoto et al. ..... 399/308
5,631,725 5/1997 Harasawa et al. ..... 399/66

*Primary Examiner*—William Royer
*Attorney, Agent, or Firm*—Oblon, Spivak, McClelland, Maier & Neustadt, P.C.

[57] ABSTRACT

An ordinary printing mode of forming an image and a transfer adjusting mode are provided and changed over. Under a condition of setting to the transfer adjusting mode, a pattern forming unit controls an exposing unit and thereby forms a toner image of a test pattern on a circumferential surface of a photosensitive body. A transfer controlling unit changes the transfer condition for electrostatically absorbing the toner image. An electric potential measuring unit measures a surface electric potential at a specified position. A condition detecting unit detects a condition of minimizing a rate "$\Delta Vs/\Delta T$" of a variation $\Delta T$ of the transfer condition and a variation $\Delta Vs$ of the surface electric potential on the photosensitive body. A condition setting unit adjusts the transfer condition in the ordinary printing mode based on the above transfer condition, and thereby the transfer unit can be adjusted to an optimum state.

18 Claims, 7 Drawing Sheets

IMAGE FORMING APPARATUS AND METHOD OF FORMING AN IMAGE WITH ENHANCED TRANSFER CONDITION SETTINGS

BACKGROUND OF THE INVENTION

1. Field of the Invention

The present invention relates to an image forming apparatus of an electrophotographic type and a method of forming an image.

2. Description of the Related Art

At present, an image forming apparatus of an electrophotographic type is utilized in a printer section for a laser printer, a copying machine, etc. Generally, a background image forming apparatus includes a photosensitive drum capable of rotating freely which is employed as a photosensitive body.

On an endless circumferential surface of the photosensitive drum capable of freely rotating, there are arranged, in order, a charger employed as a charging unit, a laser scanner as an exposing unit, a developing unit, and a transfer charger as a transfer unit opposed to the circumferential surface of the photosensitive drum. Furthermore, the apparatus is also provided with a paper conveying mechanism for conveying paper to be printed. A conveying path for conveying the paper is formed such that the paper passes through a gap between the photosensitive drum and the transfer charger.

In the case of forming an image by use of such an image forming apparatus, the rotating circumferential surface of the photosensitive drum is charged by the charger, and an electrostatic latent image is formed on the charged circumferential surface of the photosensitive drum by optical scanning of the laser scanner. The electrostatic latent image thus formed is developed with toner by the developing unit. The paper conveying mechanism conveys the paper to be printed in synchronism with such operations as mentioned above, and thereby the transfer charger electrostatically absorbs the toner image formed on the circumferential surface of the photosensitive body, and transfers the toner image onto the paper to be printed. According to the above-mentioned image forming apparatus, the transfer charger transfers the toner image on the photosensitive drum onto the paper.

Furthermore, there exists another image forming apparatus provided with an intermediate transfer unit. In such an image forming apparatus, for instance, the intermediate transfer unit includes an endless transfer belt. The transfer belt is suspended by plural guide rollers so as to circulate freely thereon. In such an apparatus, the toner image on the circumferential surface of the photosensitive drum is electrostatically absorbed onto the circumferential surface of the transfer belt. The toner image on the circumferential surface of the transfer belt is also electrostatically absorbed by another separate transfer charger, and thereby the toner image is transferred onto the paper.

Such a structure provided with the intermediate transfer unit is generally utilized for a color image forming apparatus. In such an image forming apparatus, a plurality of developing units are provided, and respective color toners are contained in the developing units respectively. When a color image is formed, the photosensitive drum is circulated repeatedly and each color toner image is formed one by one, and the respective color images are superposed in order on the circumferential surface of the transfer belt, and thereby the full-color toner image is formed. Finally, the color image thus completed on the circumferential surface of the transfer belt is transferred one time onto the surface of the paper.

Furthermore, in the above-mentioned various sorts of image forming apparatuses, there exists an apparatus having a photosensitive belt, another apparatus having an intermediate transfer unit provided with a transfer drum as a transfer body, and a combination thereof.

In all of the above-mentioned various sorts of image forming apparatuses, electric potential is created between the photosensitive body and the transfer unit, and thereby the toner image on the surface of the photosensitive body is electrostatically absorbed onto the circumferential surface of the transfer unit. Consequently, a transfer voltage of the transfer unit exerts an influence on the transfer efficiency thereof.

For instance, if a transfer voltage of the transfer unit is not sufficient, and thereby the electric potential difference between the photosensitive body and the transfer unit becomes insufficient, the toner cannot move preferably from the photosensitive body to the transfer unit. Therefore, the quality of the image is lowered and a burden on a toner cleaner increases inevitably. However, in the case of excessively increasing (raising) the transfer voltage of the transfer unit for preventing the above problems, electric power is unnecessarily consumed. Furthermore, as a result of the excessive voltage of the transfer unit, the toner is charged to an inverse polarity and is scattered around. Furthermore, the toner moves before the photosensitive body and the transfer unit are opposed to each other. Thereby, image quality is deteriorated.

In such a situation, in an image forming apparatus, the transfer conditions of a transfer unit are set in consideration of the above-mentioned matters. However, an optimum transfer condition of the transfer unit varies due to operational environments of the image forming device and time-elapsing variations of the respective portions. In order to cope with such problems, a temperature sensor and a humidity sensor can be disposed in the interior of the image forming apparatus and the transfer conditions of the transfer unit can be adjusted in accordance with the detected temperature and humidify. Furthermore, it may also be possible to forecast the time-elapsing variations of the photosensitive body and the transfer unit and to adjust the transfer conditions of the transfer unit time-elapsingly in accordance with the results of the above forecasting.

However, the above-mentioned two technologies can cope with only one of the environmental variations and the time elapsing variations. Although it is possible to employ a combination of these technologies, since the structure for realizing that may become complicated and the respective errors may be superposed (multiplied), both of these technologies are not practical. Furthermore, although the above-mentioned technologies take into consideration the environmental variations and the time-elapsing variations, both of these technologies cannot cope with manufacturing errors of a transfer unit or a transfer body exerting a prominent influence on transfer efficiency.

SUMMARY OF THE INVENTION

The present invention is made in consideration of the above-mentioned problems.

It is an object of the present invention to solve the problems as mentioned heretofore.

It is another object of the present invention to provide an image forming apparatus capable of preventing a transfer voltage from exerting an influence on a transfer efficiency of a transfer unit by electrostatically absorbing a toner image on a photosensitive body onto a circumferential surface of the transfer unit.

It is still another object of the present invention to provide an image forming apparatus which does not unnecessarily consume electric power.

It is still another object of the present invention to provide an image forming apparatus in which toner is not charged to an inverse polarity and is not scattered, and in which the toner does not move before a photosensitive body and a transfer unit are opposed to each other, to prevent image quality deterioration.

It is still another object of the present invention to provide an image forming apparatus capable of forecasting time-elapsing variations of a photosensitive body and a transfer unit and adjusting transfer conditions of a transfer unit time-elapsingly in accordance with results of the above forecasting.

It is still another object of the present invention to provide an image forming apparatus which takes into consideration environmental variations and time-elapsing variations and which can cope with manufacturing errors of the transfer unit or transfer body exerting a prominent influence on the transfer efficiency.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
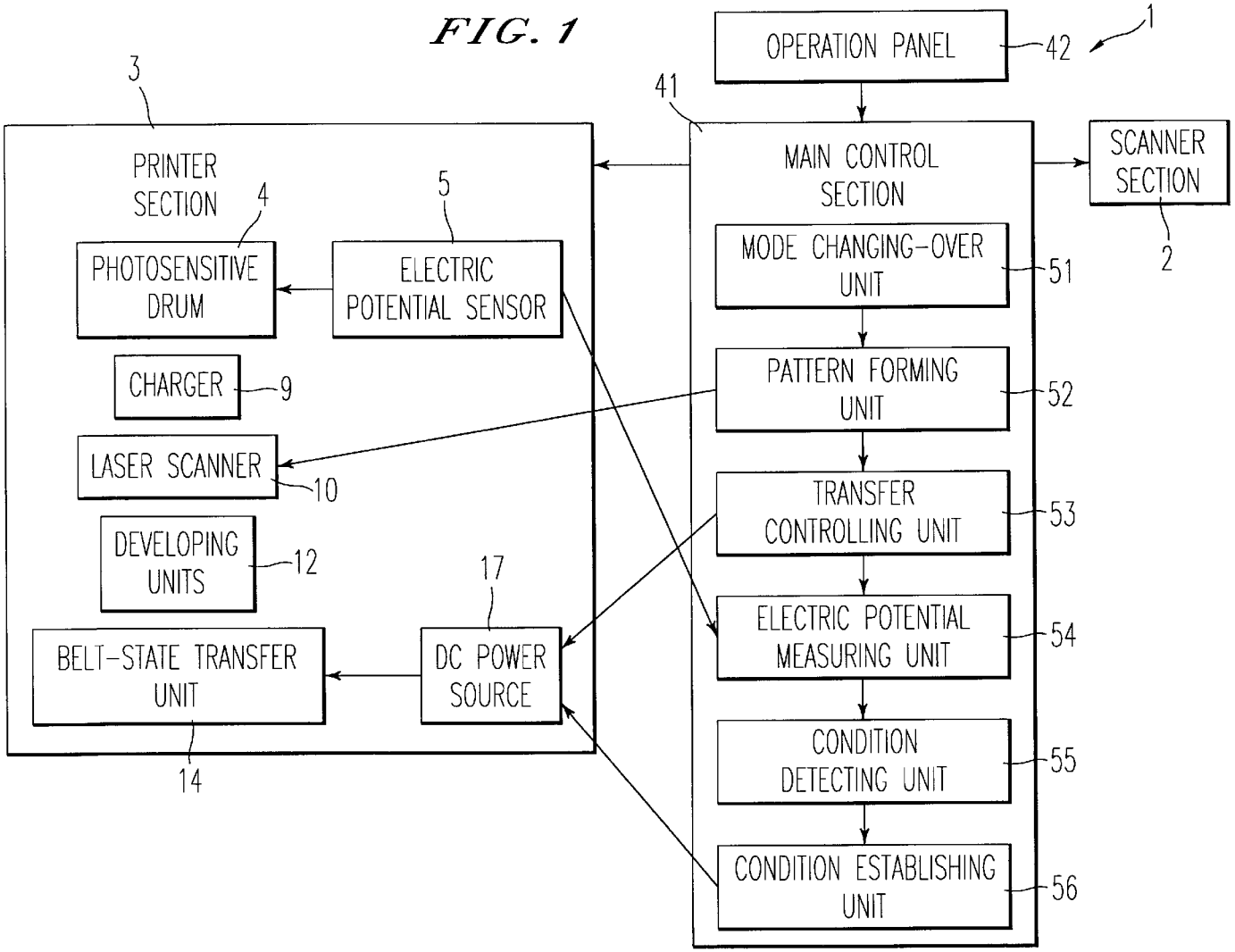
FIG. 1 is an explanatory diagram for illustrating a logical construction of a digital copying machine which is an embodiment of an image forming apparatus according to the present invention.

The preferred embodiments of the present invention are described in detail hereinafter, referring to the accompanying drawings.

An image forming apparatus of the present invention includes an endless photosensitive body, a charger, an exposing unit, a developing unit, a transfer unit, an electric potential sensor, a mode changing over unit, a pattern forming unit, a transfer controlling unit, an electric potential measuring unit, a condition detecting unit, and a condition setting unit.

In such a structure, when an ordinary printing mode is set to a mode changing over unit as an operational mode, a circulating endless circumferential surface of the photosensitive body is charged by the charger, and an electrostatic latent image is formed by the exposing unit on the circumferential surface of the photosensitive body thus charged. The electrostatic latent image on the circumferential surface of the photosensitive body is developed with toner by the developing unit. The toner image formed on the circumferential surface of the photosensitive body is electrostatically absorbed to the transfer unit. On the other hand, when a transfer adjusting mode is set to the mode changing over unit as the operational mode, the pattern forming unit controls the operation of the exposing unit and further operates the charger and the developing unit, and thereby the transfer unit in which the operation of the test pattern toner image is controlled by the transfer controlling unit changes a transfer condition T and electrostatically absorbs the toner image.

Thereafter, a surface electric potential Vs at a position where the toner image on the photosensitive body is electrostatically absorbed is measured by an electric potential sensor in the electric potential measuring unit. The transfer condition T for minimizing a rate "$\Delta Vs/\Delta T$" of the variation $\Delta T$ of the transfer condition of the transfer unit and the variation $\Delta Vs$ of the surface electric potential on the photosensitive body is detected by the condition detecting unit. Since the transfer condition T of the transfer unit in an ordinary printing mode is adjusted by the condition setting unit on the basis of the transfer condition T thus detected, the transfer unit practices the transfer operation in accordance with the adjusted transfer condition at an ordinary printing mode subsequent thereto.

For instance, if the transfer condition T of the transfer unit is transfer voltage, when the transfer voltage is lower than the proper value, the transfer rate is also low, and thereby the surface electric potential Vs may become high. Starting at such a state, when the transfer voltage is gradually increased, the transfer rate is also increased, and thereby the surface electric potential Vs is lowered.

However, when the transfer voltage exceeds the proper value area and is further raised, a phenomenon of inverting the polarity of the toner charging may occur, and thereby the transfer rate is lowered and the surface electric potential Vs of the photosensitive body starts to be lowered. Namely, when the transfer voltage is proper, the transfer rate becomes a maximum and the variation ΔVs of the surface electric potential becomes a minimum. Consequently, when the value of the rate "ΔVs/ΔT" is a minimum, the transfer condition T may become optimum. Since the transfer condition T is detected at the transfer adjusting mode and the transfer condition is adjusted at the ordinary printing mode, the transfer unit operates in accordance with the optimum transfer condition in the ordinary printing mode.

Moreover, regarding such a transfer unit, it may be allowed to employ a transfer charger for electrostatically absorbing the toner image and transfer the toner image thus absorbed directly to the printing paper, and it may further be allowed to employ an intermediate transfer unit for electrostatically absorbing the toner image and thereafter transferring again the toner image thus absorbed onto the printing paper.

On the other hand, regarding such a transfer body, it may be allowed to employ an endless transfer belt capable of freely circulating, a transfer drum capable of freely rotating, or the like.

The image forming apparatus may further include a transfer body, a position detecting unit, and a timing controlling unit, in addition to the elements noted above.

In such a structure, when the transfer unit operates under the condition of setting to an ordinary printing mode, the transfer unit causes the endless circumferential surface of the transfer body to circulate and electrostatically absorb the toner image. When the pattern forming unit and the electric potential measuring unit operate under the condition of setting to the transfer adjusting mode, the position detecting unit detects the circulating position on the circumferential surface of the transfer body. The timing controlling unit controls the operations of the pattern forming unit and the electric potential measuring unit on the basis of the circulating position thus detected. Thereby, the position for forming the test pattern on the surface of the photosensitive body and the other position for measuring the surface electric potential respectively correspond to the predetermined positions on the circumferential surface of the transfer body. For instance, in a case that the transfer property of the transfer body is not uniform in the circumferential direction due to a manufacturing error, etc., if the plural measuring positions for measuring the surface electric potential of the photosensitive body for the transfer condition changed in order to correspond to the plural positions on the circumferential surface of the transfer body, the non-uniformity of the transfer property of the transfer body exerts an influence on the measuring result of the surface electric potential.

However, if the plural measuring positions of the surface electric potential of the photosensitive body for the transfer condition changed in order to correspond to the predetermined positions, the non-uniformity of the transfer property of the transfer body does not exert any influence on the measuring result of the surface electric potential. Namely, in the case of practicing several times the formation of the test pattern and the measurement of the surface electric potential by changing the transfer condition of the transfer unit, the circumferential surface of the transfer body several times corresponding to the above-mentioned repetition times, and the formation of the test pattern and the measurement of the surface electric potential are practiced per each revolution of the transfer body.

The image forming apparatus may include an endless photosensitive body, a charger, an exposing unit, a developing unit, a transfer unit, a first electric potential sensor, a second electrical potential sensor, a mode charging over unit, an operation controlling unit, a transfer controlling unit, a first electric potential measuring unit, a second electric potential measuring unit, a condition detecting unit, and a condition setting unit.

In such a structure, in the case of setting the ordinary printing mode as the operation mode to the mode changing over unit, the circulating endless circumferential surface of the photosensitive body is charged by the charger, and an electrostatic latent image is formed on the circumferential surface of the photosensitive body thus charged by use of the exposing unit. The electrostatic latent image formed on the circumferential surface of the photosensitive body is developed with the toner by use of the developing unit. The toner image on the photosensitive body is electrostatically absorbed to the transfer unit.

On the other hand, in the case of setting a transfer adjusting mode as the operation mode to the mode changing over unit, the transfer condition T of the transfer unit is changed by the transfer controlling unit, and the surface electric potentials Vo and Vd on an upstream side and a downstream side of the transfer unit are respectively measured by the first and second electric potential sensors in the first and second electric potential measuring units. The transfer condition T for the variation value "Vd−Vo" of the surface electric potential to satisfy the predetermined tolerable area is detected by the condition detecting unit. Since the transfer condition of the transfer unit at the ordinary printing mode is adjusted by the condition setting unit on the basis of the transfer condition T thus detected, the transfer unit practices the transfer operation at the ordinary printing mode subsequent thereto in accordance with the adjusted transfer condition.

For instance, in a case that the transfer condition T of the transfer unit is transfer voltage, when the voltage is lower than the proper value, the transfer rate is also low, and thereby the variation value "Vd−Vo" of the surface electric potential on the photosensitive body becomes high.

In such a state, when the transfer voltage is gradually raised, the transfer rate is increased corresponding thereto, and thereby the variation value "Vd−Vo" of the surface electric potential on the photosensitive body is lowered. In the state that the variation value "Vd−Vo" of the surface electric potential satisfies the predetermined tolerable area, the transfer voltage comes in the proper area. Consequently, if the transfer condition T is detected in the transfer adjusting mode and the transfer condition in the ordinary printing mode is adjusted, the transfer unit operates in accordance with the optimum transfer condition in the ordinary printing mode subsequent thereto.

The image forming apparatus may further include a transfer body, a position detecting unit, and a timing controlling unit, in addition to the elements noted above.

In such a structure, when the transfer unit operates under the condition of setting to an ordinary printing mode, the transfer unit causes the endless circumferential surface of the transfer body to circulate and electrostatically absorb the toner image. When the first and second electric potential measuring units operate under the condition of setting to the transfer adjusting mode, the position detecting unit detects the circulating position on the circumferential surface of the transfer body and the timing controlling unit controls the operations of the first and second electric potential measuring units, and thereby the measuring position of the surface electric potential on the photosensitive body is caused to correspond to the predetermined position on the circumferential surface of the transfer body.

For instance, in a case that the transfer property of the transfer body is not uniform in the circumferential surface direction due to a manufacturing error, etc., if the plural measuring positions of the surface electric potential on the photosensitive body correspond to the plural positions on the circumferential surface of the transfer body, the non-uniformity of the transfer property of the transfer body does not exert any influence on the measuring result of the surface electric potential. Namely, in the case of changing the transfer condition of the transfer unit and measuring the surface electric potential of the photosensitive body from one time to several times, the circumferential surface of the transfer body is repeatedly circulated several times corresponding to the above repetitive times, and the surface electric potential of the photosensitive body is measured per each revolution of the transfer body.

The image forming apparatus may include an endless photosensitive body, a charger, an exposing unit, a developing unit, a transfer unit, an electric potential sensor, a mode changing over unit, an operation controlling unit, an electric potential measuring unit, a position detecting unit, an electric potential memorizing unit, a condition creating unit, and a condition setting unit.

In such a structure, when an ordinary printing mode is set to the mode changing over unit as an operational mode, the circulating endless circumferential surface of the photosensitive body is charged by the charger, and an electrostatic latent image is formed on the circumferential surface of the charged photosensitive body by use of the exposing unit. The electrostatic latent image on the circumferential surface of the photosensitive body is developed with the toner by use of the developing unit. The toner image on the circumferential surface of the photosensitive body is electrostatically absorbed onto the circulating endless circumferential surface of the transfer body.

On the other hand, when a transfer adjusting mode is set to the mode changing over unit as the operation mode, the surface electric potential Vd is measured by the electric potential sensor in the electric potential measuring medium at a position downstream from the transfer unit. The circulating position on the circumferential surface of the transfer body is detected by the position detecting unit. The pattern of the surface electric potential Vd on the photosensitive body per each revolution of the transfer body on the basis of the detected circulating position is memorized in the electric potential memorizing unit.

Corresponding to the memorizing pattern, the pattern of the transfer condition T per each revolution of the transfer body in which the surface electric potential Vd of the photosensitive body is made constant corresponding to the memorized pattern is created by the condition creating unit. Since the transfer condition per each revolution of the transfer body at the ordinary printing mode is adjusted by the condition setting unit corresponding to the pattern of the transfer condition T thus created, the transfer unit practices the transfer operation in accordance with the transfer condition thus adjusted at the ordinary printing mode subsequent hereto. For instance, even though the transfer property of the transfer body is not uniform in the circumferential surface direction thereof, the transfer condition of the transfer unit is established so as to make uniform the transfer efficiency corresponding thereto.

In the image forming apparatus the transferring body may be composed of an endless transfer belt, and the transfer belt may be composed of plastic elements made by fusing and pushing out in an axis core direction perpendicular to the circumferential surface direction.

In such a structure, since the plastic elements thus made by fusing and pushing out have a uniformity in a direction perpendicular to the pushing-out direction, the transfer belt formed by fusing and pushing out in the axis core direction perpendicular to the circumferential surface direction has a uniform transfer property in the circumferential surface direction.

In the image forming apparatus a transfer body for electrostatically absorbing the toner onto the endless circumferential surface thereof capable of freely circulating may be provided in the transfer unit, the transfer body and the photosensitive body may be brought into direct contact with each other in the circumferential surface direction over a predetermined nip length, the pattern forming means may successively arrange plural test patterns on the circumferential surface of the photosensitive body through gaps longer than the nip length, and the transfer controlling unit may vary the transfer condition T with a timing when the transfer body is brought into direct contact with the position of the gap between the patterns on the circumferential surface of the photosensitive body.

In such a structure, the plural test patterns are successively arranged on the circumferential surface of the photosensitive body through the gap not smaller than the nip length by use of the pattern forming unit. Since the transfer controlling medium changes the transfer condition T with the timing when the transfer body is brought into direct contact with a position of the gap between the plural test patterns, the transfer condition T of the transfer unit is not changed at all at a half way of one test pattern, and thereby the surface electric potential Vs of the photosensitive body is individually measured on the plural positions of the test pattern.

An embodiment of the invention is explained hereinafter, referring to the accompanying drawings.

Figure 2:
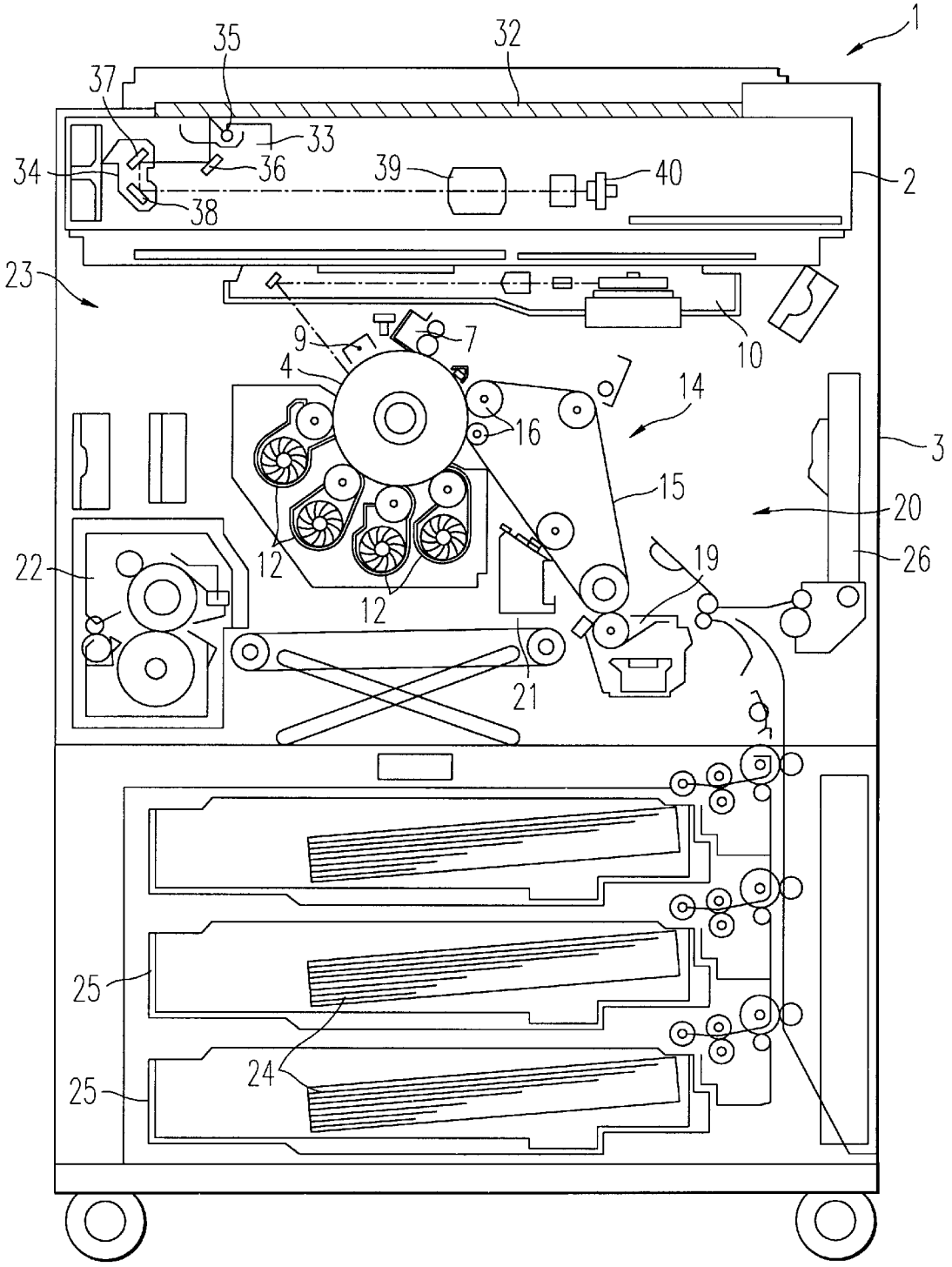
FIG. 2 is a cross sectional view showing an internal construction of a digital copying machine according to a present invention.

At first, a digital copying machine 1 shown as an example of an image forming apparatus of an embodiment is composed of, as shown in FIG. 2, a scanner section 2 employed as an image reading unit for reading out an image on a manuscript document to be read, a printer section 3 employed as an image forming unit for forming an image on a printing paper, and a control section including an operation panel.

Figure 4:
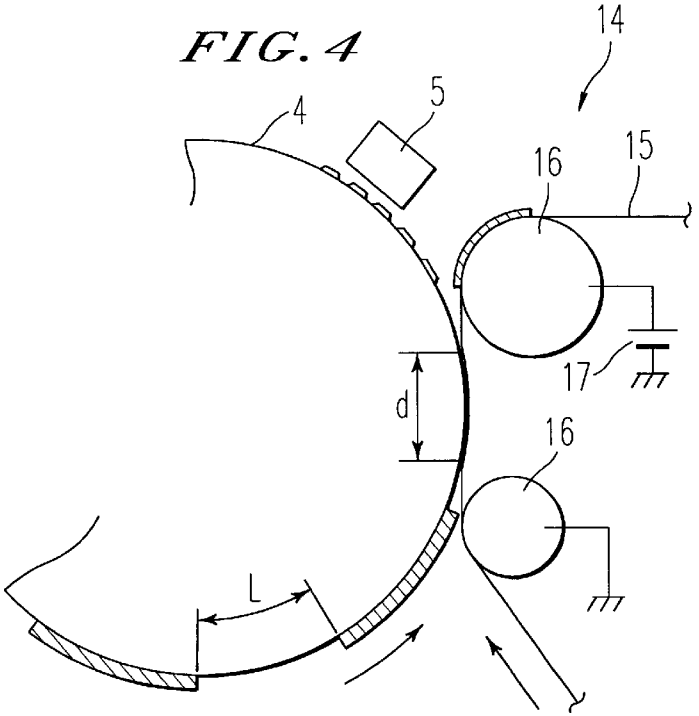
FIG. 4 is an explanatory diagram showing a relationship of a length of a nip between a photosensitive drum (photosensitive body) and an intermediate transfer belt and a gap between plural test patterns.
Figure 3:
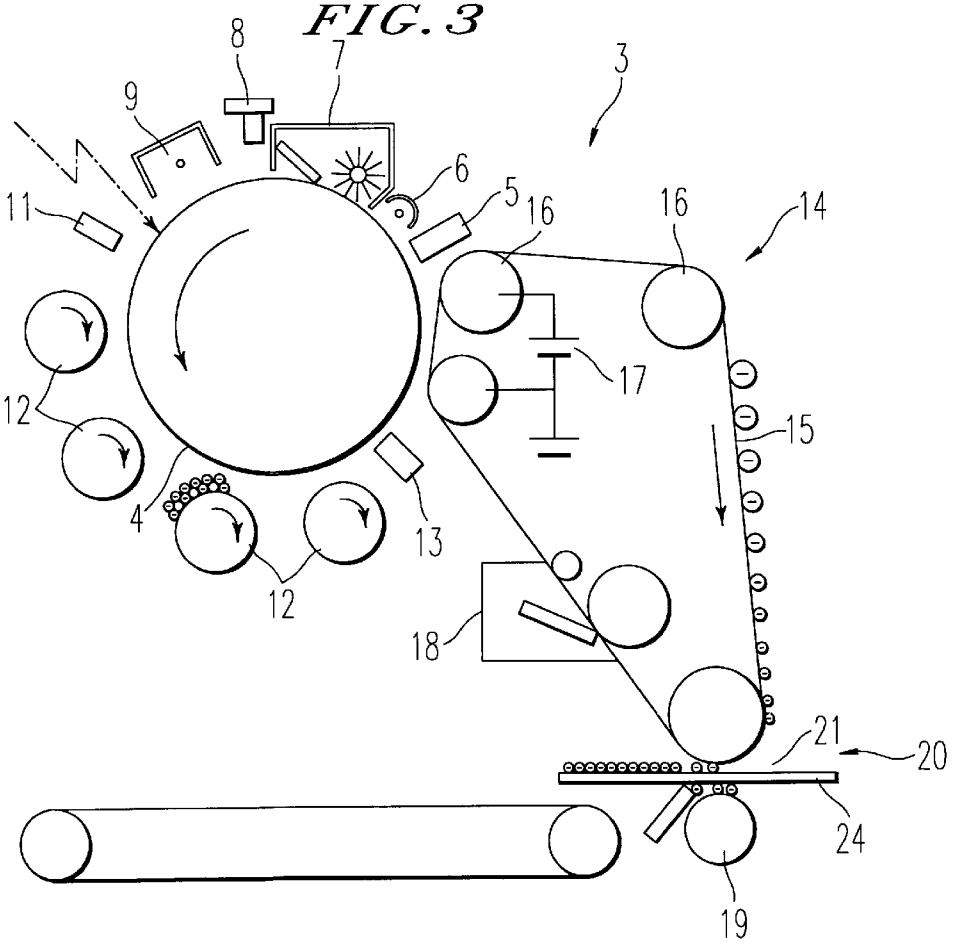
FIG. 3 is a front view showing a part of an electrophotographic mechanism.

As shown in FIGS. 2 through 4, a photosensitive drum 4 employed as a photosensitive body is rotatably and pivotally supported on an upper part in an interior of the printer section 3. An electric potential sensor 5, a cleaning charger 6, a drum cleaner 7, a charge removing lamp 8, a charger 9 employed as a charging unit, a laser scanner 10 employed as an exposing unit, a latent image electric potential sensor 11, four developing units 12, a process sensor 13, a belt-state transfer unit 14 employed as an intermediate transfer unit, etc. are arranged on a circumferential surface of the photosensitive drum 4.

The belt-state transfer unit 14 includes an endless intermediate transfer belt 15 as a transfer body. The intermediate transfer belt 15 is suspended circulatably by plural guide rollers 16. A circumferential surface of the aforementioned intermediate transfer belt 15 thus suspended is brought into pressurized contact with a circumferential surface of the photosensitive drum 4 with a predetermined nip length d (see FIG. 4), and a DC power source 17 for generating a variable output voltage is connected to the aforementioned guide roller 16 located at upstream and downstream sides on the above-mentioned location.

A belt cleaner 18 and a roller transfer unit 19 as a final transfer unit are also disposed to oppose the circumferential surface of the aforementioned intermediate transfer belt 15. A paper conveying path 21 of the paper conveying mechanism 20 is located at a gap between the roller transfer unit 19 and the intermediate transfer belt 15. Since a fixing unit 22 is disposed on the paper conveying path 21, an electrophotographic mechanism 23 is formed in the interior of the aforementioned printer section 3.

A plurality of paper feeding cassettes 25 or a paper feeding tray 26 are installed on a position communicating with the paper conveying path 21 in the electrophotographic mechanism 23 in order to supply various sorts of printing paper 24 which may be respectively different from each other in size and direction. Only one printing paper 24 among the plural printing papers 24 is selectively supplied to the aforementioned electrophotographic mechanism 23 at a time. Furthermore, since the printer section 3 of the digital copying machine 1 shown as an example forms a full-color image on the printing paper 24 by use of the aforementioned electrophotographic mechanism 23 in accordance with various sorts of information established in advance, color toners of YMCK (Yellow, Magenta, Cyanide, Black) (not shown) are respectively accommodated in the aforementioned four developing units 12.

The photosensitive drum 4 may be composed of a structure of an aluminum rare tube having a circumferential surface coated with a photosensitive layer. The photosensitive layer may be formed as one of a function-separating type which is made by piling in order a basic layer (substrate), a charge generating layer, and a charge transferring layer. The thickness of the photosensitive layer thus formed may be about 28 $\mu$m and the electrostatic capacitance thereof may be about 90 pF/cm$^2$.

The charger 9 discharges a voltage for uniformly charging the circumferential surface of the photosensitive drum 4 to a level of, e.g., −650 V−−700 V. The laser scanner 10 outputs a scanning light beam for removing charge to a level of, e.g., −100 V−−500 V from the charged circumferential surface of the photosensitive drum 4. The developing units 12 generate a developing bias of, e.g., −500 V−−550 V.

The intermediate transfer belt 15 may be composed of fluorine resin such as ethylene tetrafluoroethylene or a single-layer medium-resistance-value resistor made by dispersing carbon black into polycarbonate. The intermediate transfer belt may be manufactured as plastic elements made by fusing and pushing out in an axis core direction perpendicular to the circumferential surface direction. Since a resistivity (specific resistance) thereof may be $1\times10^{11}$ Ω cm$^2$ and a thickness thereof may be 150 $\mu$m, the surface resistance thereof immediately after being manufactured may be $5\times10^{9}$ Ω/cm$^2$. A suspension distance of the intermediate transfer belt 15 on the position of being brought into direct contact with the photosensitive drum 4 may be about 36 mm, and the nip length d between the intermediate belt 15 and the photosensitive drum 4.

Furthermore, as shown in FIG. 2, the scanner section 2 is provided with a contact glass 32 on an upper surface of the main body housing. The manuscript document to be read out (not shown) is put on the upper surface of the contact glass 32. A first scanning unit 33 is movably supported at a position opposing the contact glass 32, and further a second scanning unit 34 is also movably supported at a position opposing the first scanning unit 33. The first scanning unit 33 may be composed of a halogen lamp 35 as an image illuminating light source and a reflection mirror 36 having a reflection surface inclined by 45°. The second scanning unit 34 may be composed of a couple of reflection mirrors 37 and 38 respectively inclined by 45° and opposing each other with an interior angle 90°.

A three-line CCD 40 is fixedly disposed through a focusing optical system 39 at a position opposing the reflection mirror 38 of the second scanning unit 34. A B line, a G line, and an R line (all not shown) composed of a CCD array for respectively reading out the image are successively arranged at a distance of several lines in the three-line CCD 40.

Hereupon, if the ratio of the scanning speeds of the first and second scanning units 33 and 34 is set to 2:1, the length of the image focusing light path communicating from the contact glass 32 through the first and second scanning units 33 and 34 to the three-line CCD 40 is always constant even though the first and second scanning units 33 and 34 move. Furthermore, by utilizing such an image focusing light path of constant length, the reflection light of the read-out image reflected from the manuscript document to be read out which is put on the contact glass 32 and illuminated by the halogen lamp 35 is opto-electrically converted to image data by the three-line CCD 40.

In the digital copying machine 1 of the present embodiment, as shown in FIG. 1, a main control section 41 is connected to the scanner section 2 and the printer section 3 and an operation panel 42 is connected to the main control section 41. The main control section 41 is composed of a computer including various sorts of hardware and establishing proper programs, and the main control section 41 realizes various functions of controlling the operation of the scanner section 2 and the printer section 3.

The digital copying machine 1 of the present embodiment includes a mode changing-over unit 51, a pattern forming unit 52, a transfer controlling unit 53, an electric potential measuring unit 54, a condition detecting unit 55, and a condition establishing unit 56, etc. The mode changing-over unit 51, for instance, changeably sets an ordinary printing mode and a transfer adjusting mode as an operational mode by a processing action of the main control section 41 corresponding to the manual operation of the operation panel 42. Under the condition of setting the ordinary printing mode, the units 52–56 do not function. The image data read-scanned from the manuscript document by the scanner section 2 is output (printed out) on the printing paper 24 by an action of the printer section 3. On the other hand, in the state of establishing the transfer adjusting mode, the units 52–56 function, and thereby the transfer condition T of the intermediate transfer belt 15 in the printer section 3 is adjusted.

At this time, the main control section 41 operates the photosensitive drum 4, the charger 9 for charging, and the developing units 12 as in the ordinary case, and the same further operates the laser scanner 10. Thereby, the pattern forming unit 52 forms the toner image of the test pattern on the circumferential surface of the photosensitive drum. As shown in FIG. 4, the plural test patterns are formed as a rectangular large-black-area image. The plural test patterns are successively arranged through the gap not less than the nip length d between the photosensitive drum 4 and the intermediate transfer belt 15. For instance, when the nip length d is 15 mm, the test pattern is formed in the shape of successively arranging the large-black-area image of 30 mm×30 mm through the gap of 20 mm.

The transfer controlling unit 53 operates the belt-state transfer unit 14, and thereby the toner image of the test pattern is electrostatically absorbed thereto from the photosensitive drum 4. At this time, by controlling an operation of the DC power source 17, the transfer voltage Vt as the transfer condition T is changed. To state in more detail, the output voltage of the DC power source 17 is set, firstly, to a voltage sufficiently lower than the ordinary transfer voltage, and the above voltage is stepwisely increased (raised) to a voltage sufficiently higher than the ordinary transfer voltage.

At this time, the main control section 41 controls the operation of the DC power source 17 corresponding to the rotational speed of the photosensitive drum 4 and the operational timing of the laser scanner 10, and thereby, the output voltage of the DC power source 17 is changed over with the timing of bringing into direct contact with the circumferential surface of the intermediate transfer belt 15 at a position of the gap of the plural test patterns on the circumferential surface of the photosensitive drum 4. Namely, the transfer voltage Vt of the intermediate transfer belt 15 is increased (raised) stepwisely per each of the plural test patterns from a voltage lower than the ordinary voltage to a voltage higher than the ordinary voltage.

The main control section 41 receives an output signal of the electric potential sensor 5 corresponding to a rotational speed of the photosensitive drum 4 and an operational timing of the laser scanner 10, and thereby the electric potential measuring unit 54 causes the electric potential sensor 5 to measure the surface electric potential Vs at the position where the toner image of the test pattern on the photosensitive drum 4 is electrostatically absorbed as mentioned above. Since the test pattern is composed of plural patch images as mentioned above, the measurement of the surface electric potential Vs is repeated corresponding to the plural test patterns.

The main control section 41 executes the predetermined operational calculation processing on the basis of the transfer voltage Vt of the belt-state transfer unit 14 and the surface electric potential Vs of the photosensitive drum 4, and thereby the condition detecting unit 55 detects the transfer voltage Vt for minimizing the ratio "ΔVs/ΔVt" of the variation value ΔVt of the transfer voltage of the belt-state transfer unit 14 and the variation value ΔVs of the surface electric potential of the photosensitive drum 4. For instance, since the plural transfer voltages Vt and the plural surface electric potentials Vs is sampled in such a situation, the variation value ΔVt is calculated as the difference "Vtn−Vtn+1" of the just adjacent two transfer voltages and the variation value ΔVs is calculated as the difference "Vsn−Vsn+1" of the just adjacent two surface electric potentials. In such a way, the ratio "ΔVs/ΔV" can be easily calculated.

The main control section 41 renews the output of the DC power source 17 of the belt-state transfer unit 14, and thereby the condition establishing unit 56 adjusts the transfer voltage of the belt-state transfer unit 14 in the ordinary printing mode on the basis of the detected transfer voltage Vt. Namely, in the present embodiment, if the test pattern is composed of the large-black-area image, the transfer voltage Vt for optimumly transferring a test pattern is not optimum for transferring a halftone image. In the digital copying machine 1 of the present embodiment, if the quality of the halftone image has priority over that of the large-black-area image, 85% of the transfer voltage Vt detected as mentioned above is established for the belt-state transfer unit 14.

Furthermore, in the digital copying machine 1 of the present embodiment, if the toners YMCK are respectively (separately) accommodated in the four developing units 12, the operations of adjusting the transfer voltage as mentioned above are individually executed for the respective toners YMCK.

In such a construction of the digital copying machine 1 of the present embodiment, an ordinary printing mode and a transfer adjusting mode are established so as to be changed over as the operational mode. Under the establishment of the ordinary printing mode, the color image read out from the manuscript document is copied onto the printing paper. To state in more detail, the image to be read is read out and scanned by the scanner section 2 and the image data RGB are output from the scanner section 2. The RGB image data are converted to YMCK image data. The YMCK image data thus converted are printed out on the printing paper 24 by the printer section 3.

At this time, the circulating endless circumferential surface of the photosensitive drum 4 is charged by corona discharging in the charger 9. An electrostatic latent image is formed on the circumferential surface of the photosensitive drum 4 thus charged by the optical scanning of the laser scanner 10. The electrostatic latent image on the circumferential surface of the photosensitive drum 4 is developed with one of the toners YMCK by one of the four developing units 12. The toner image thus developed on the circumferential surface of the photosensitive drum 4 is electrostatically absorbed onto the circumferential surface of the intermediate transfer belt 15 of the belt-state transfer unit 14.

The processing operation as mentioned above is executed in the order of the toners YMCK, and thereby a full-color toner image is formed on the circumferential surface of the intermediate transfer belt 15. The printing paper conveying mechanism 20 conveys the printing paper 24 with a predetermined timing corresponding to such an operation as mentioned above, and the full-color toner image on the circumferential surface on the intermediate transfer belt 15 is then transferred onto the surface of the printing paper 24 by the roller transfer unit 19. The printing paper 24 thus transferred with the image is heated and pressurized by the fixing unit 22, and then the printing paper 24 having the full-color toner image fixed thereon is output from the printer section 3.

On the other hand, in the case of establishing the transfer adjusting mode as the operational mode, the above-mentioned copying operation is not executed. Instead, the transfer condition of the belt-state transfer unit 14 is adjusted. On that occasion, the main control section 41 controls the operation of the laser scanner 10 and the operations of the charger 9 and the developing units 12, and thereby forms a toner image of plural test patterns on the circumferential surface of the photosensitive drum 4. The toner image of the plural test patterns on the circumferential surface of the photosensitive drum 4 is then electrostatically absorbed to the intermediate transfer belt 15 of the belt-state transfer unit 14. At this time, the main control section 41 stepwisely raises the transfer voltage Vt of the belt-state transfer unit 14 per each of the plural test patterns from a voltage sufficiently lower than an ordinary voltage to another voltage sufficiently higher than the ordinary voltage.

When the toner image of the plural test patterns is electrostatically absorbed from the circumferential surface of the photosensitive drum 4, the main control section 41 measures the surface electric potentials Vs on the respective positions thereof by use of the electric potential sensor 5. The main control section 41 calculates the ratio "ΔVs/ΔVt" of the variation ΔVt of the transfer voltage of the belt-state transfer unit 14 and the variation ΔVs of the electric potential on the surface of the photosensitive drum 4. Next, the main control section 41 detects the transfer voltage Vt for minimizing the value of the ratio "ΔVs/ΔVt", and establishes 85% of the transfer voltage Vt as the transfer voltage of the belt-state transfer unit 14 for the ordinary printing mode.

Since the transfer voltage of the belt-state transfer unit 14 is optimumly adjusted by such a processing operation as mentioned above, the toner image can be optimumly transferred from the photosensitive drum 4 to the belt-state transfer unit 14 in a copying operation subsequent to the above processing operation.

Figure 5:
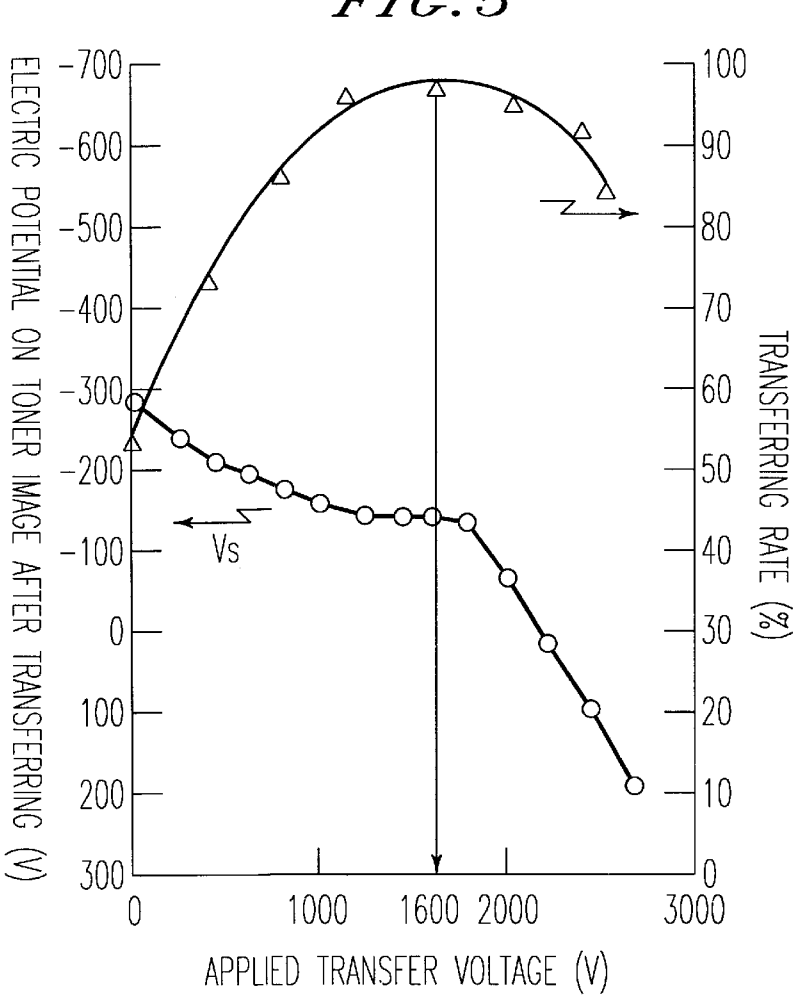
FIG. 5 is a graph showing a relationship of a transfer voltage of a belt-state transfer unit, a transfer rate thereof, and a surface electric potential of a photosensitive body, in an embodiment of the present invention.

For instance, when the transfer voltage Vt of the belt-state transfer unit 14 is lower than the proper value, the transfer rate is also lower than the proper value. Therefore, the surface electric potential Vs remaining on the circumferential surface of the photosensitive drum 4 is higher than the proper value. As shown in FIG. 5, when the transfer voltage Vt is successively raised (increased) starting from such a condition, the transfer rate is also raised corresponding thereto, and thereby the surface electric potential Vs of the photosensitive drum 4 is lowered. However, when the transfer voltage exceeds the area of the proper value and further rises up, a phenomenon that the charging polarity of the toner is inverted, etc. may occur. Consequently, the transfer rate is lowered and thereby the surface electric potential Vs of the photosensitive drum 4 is also lowered.

Namely, when the transfer voltage is proper, the transfer rate becomes a maximum and the variation ΔVs of the surface electric potential becomes a minimum. Consequently, when the ratio "ΔVs/Δt" is a minimum, the transfer voltage Vt becomes optimum. However, although the transfer voltage Vt is optimum for the test pattern of the large-black-area image, it is not optimum for a halftone image. Therefore, in such a situation, giving priority for the halftone image, 85% of the transfer voltage is set to the belt-state transfer unit 14.

To state more concretely, when the processing operation of the above-mentioned transfer adjusting mode was executed by use of a newly-manufactured digital copying machine 1, the transfer voltage Vt≈1600 V could be detected as the most suitable for the large-black-area image. Hereupon, when 1360 V (85% of 1600 V) was set to the belt-state transfer unit 14 as the transfer voltage, the digital copying machine 1 could perform preferably an operation of copying from a halftone image to the large-black-area image.

Figure 6:
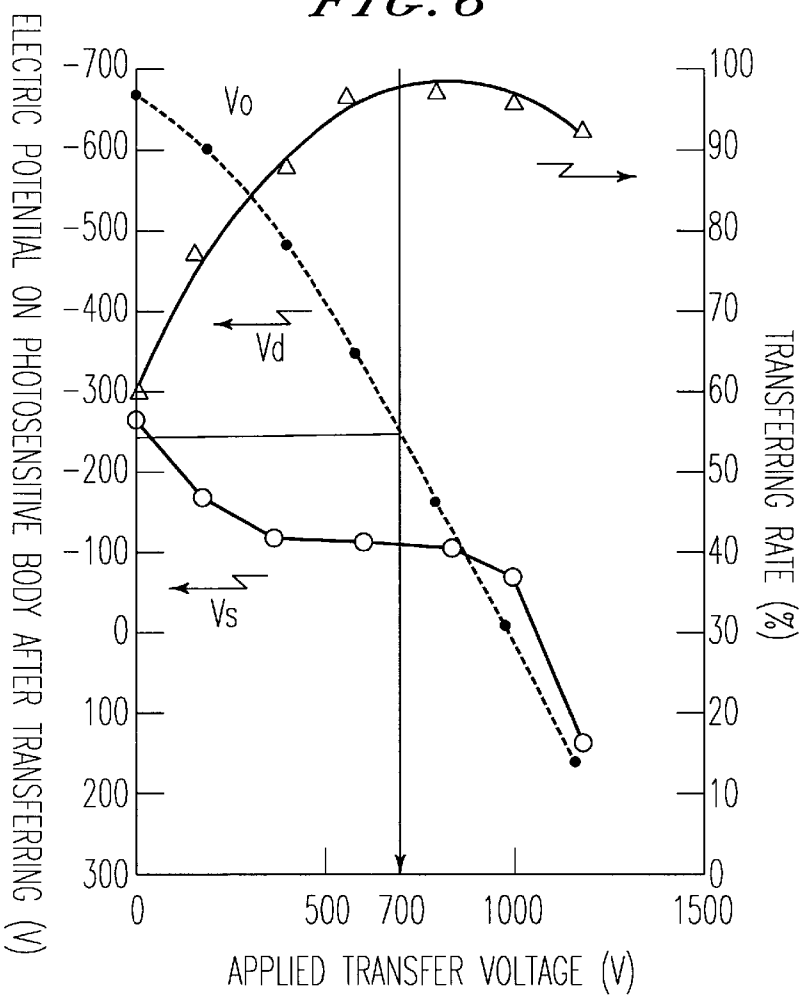
FIG. 6 is a graph showing a relationship of a transfer voltage of a belt-state transfer unit, a transfer rate thereof, and a surface electric potential of a photosensitive body, in a first modification of an embodiment of the present invention.

However, when a running test was executed by use of the digital copying machine 1, a phenomenon of toner dispersion occurred on the halftone image after copying about 5000 sheets of printing paper. At this time, the surface electric potential of the intermediate transfer belt 15 was measured, and thereby it could be made clear that the intermediate transfer belt 15 was deteriorated with time elapsing from $5\times10^9$ Ω/cm$^2$ (at the time of newly manufacturing) to $5\times10^7$ Ω/cm$^2$. In such a situation, when the processing operation of the transfer adjusting mode was executed in the digital copying machine 1, an optimum transfer voltage Vt≈700 V could be detected in the large-black-area image as shown in FIG. 6. On such a condition, when 595 V (85% of 700V) was set to the belt-state transfer unit 14 as the transfer voltage, the copying operation could be preferably performed from the halftone image to the large-black-area image.

Since the digital copying machine 1 can transfer a halftone toner image on the best conditions by adjusting the transfer voltage of the belt-state transfer unit 14, the color image can be copied with high image quality. Furthermore, since the transfer voltage is not unnecessarily set to a high value, consumed power can be reduced. Furthermore, since the transfer voltage adjusting operation as mentioned above can be executed whenever occasion demands at the time of initializing, it is possible to always maintain a best transfer efficiency regardless of environmental variations and time elapsing deteriorations.

Moreover, since the digital copying machine 1 of the present embodiment changes the belt-state transfer voltage Vt with the timing of directly bringing the circumferential surface of the transfer unit 14 with the position of the gap between the test patterns on the circumferential surface of the photosensitive drum 4, the transfer voltage Vt of the belt-state transfer unit 14 does not change at all at a halfway of one test pattern, and thereby changing of the transfer voltage Vt and measurement of the surface electric potential Vs can be executed at a shortest time interval. For this reason, the operation of adjusting the transfer voltage Vt can be completed promptly, and thereby it is possible to prevent unnecessary consumption of toner.

Furthermore, in the digital copying machine 1 according to the present embodiment, since the endless intermediate transfer belt 15 is formed by fusing and pushing out in an axis core direction perpendicular to the circumferential surface direction, the transfer property is uniform in the direction of the circumferential surface. For instance, in a case that the transfer property of the intermediate transfer belt 15 is not uniform in the circumferential surface direction, even though the plural test patterns are transferred in order in the direction of the circumferential surface of the intermediate transfer belt 15 and the surface electric potential Vs remaining on the photosensitive drum 4 is measured, the non-uniformity of the transfer property of the intermediate transfer belt 15 exerts an influence on the surface electric potential Vs. However, if the intermediate transfer belt 15 is formed by fusing and pushing out in the axis core direction and the transfer property thereof is made uniform in the circumferential surface direction, the surface electric potential Vs of the photosensitive drum 4 can be preferably detected, and thereby the optimum transfer voltage can be determined properly.

Moreover, the present invention is not limited to only the above-mentioned embodiment, but various sorts of modifications are possible. For instance, although the belt-state transfer unit 14 having the intermediate transfer belt 15 is shown as an example of the transfer unit in the present embodiment, it is also possible to employ a drum-state transfer unit having a transfer drum. Furthermore, although the present embodiment shows as an example that the belt-state transfer unit 14 electrostatically absorbs the toner image from the photosensitive drum 4, and further that the roller transfer unit 19 electrostatically absorbs the toner image absorbed onto the belt-state transfer unit 14 and finally transfers the image thus absorbed onto the surface of the printing paper 24, it is also possible to employ such a roller transfer unit 19 as the above belt-state transfer unit 14 and adjust the transfer condition in such a way as mentioned above.

Furthermore, although the transfer condition to be adjusted is the transfer voltage of the belt-state transfer unit 14 in the present embodiment, it is also possible to adjust the transfer current or the tension of the intermediate transfer belt 15 as the transfer condition to be adjusted instead of the transfer voltage. Moreover, although it is shown as an example to adjust the transfer condition for each of the respective toners YMCK in the present embodiment, it is also possible to intensively collect the adjusting operation to a one-time operation as a representative one of the toners. For instance, in the case of stepping up the transfer voltage for the respective toners at the time of forming the color image, if the transfer voltage of one of the toners which is optimumly adjusted is multiplied by a proportional coefficient for stepping up the voltages of the other toners, it turns out to be possible to adjust optimumly the transfer voltages for the respective color toners.

Figure 7:
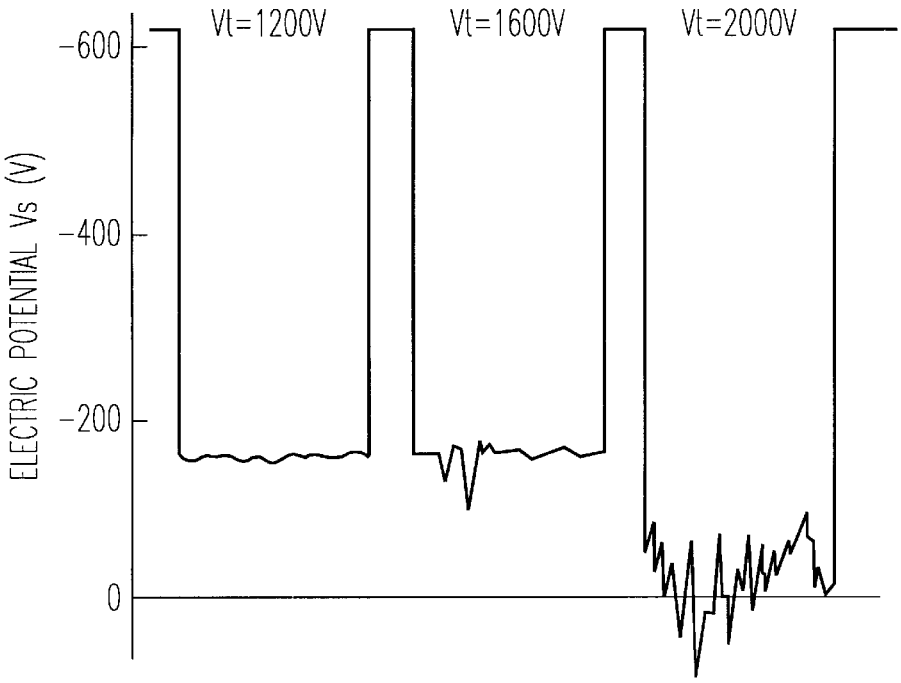
FIG. 7 is a graph showing a not-uniform (uneven) state of a transfer property of an intermediate transfer belt in a circumferential surface direction.

Moreover, in the present embodiment, by forming the endless intermediate transfer belt 15 by fusing and pushing out in an axis core direction, the transfer property in the circumferential surface direction can be made uniform, and thereby the transfer voltage can be detected properly. However, as shown in FIG. 7, the transfer property of the intermediate transfer belt 15 may become non-uniform in the circumferential direction on some occasions due to time-elapsing variations such as a manufacturing error. In such a situation, it is preferable to provide a position detecting unit and a timing control unit and to cause the test pattern forming position and the surface electric potential Vs measuring position to correspond to the predetermined position of the intermediate transfer belt 15.

Figure 8:
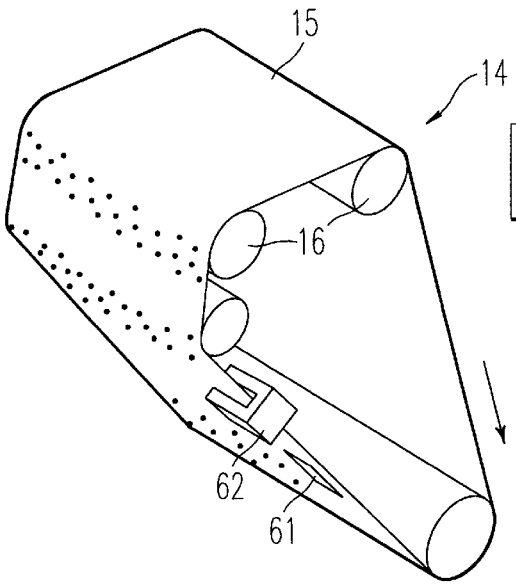
FIG. 8 is a perspective view showing a belt-state transfer unit of a second modification of an embodiment of the present invention.
Figure 9:
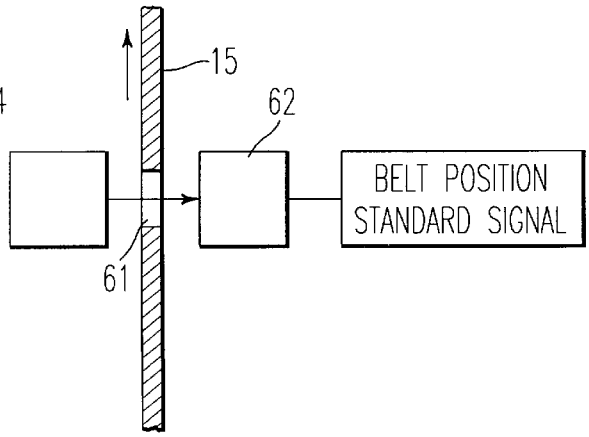
FIG. 9 is an explanatory diagram showing a main part of an image forming apparatus of the present invention.

To state more concretely, as shown in FIG. 8 and FIG. 9, a through hole 61 is formed (bored) on a side edge portion of the intermediate transfer belt 15, and further a photo-coupler 62 is disposed at a position for detecting the through hole 61. The photo-coupler 62 is connected to the main control section 41, and the main control section 41 controls the operations of the pattern forming unit 52 and the electric potential measuring unit 54. In such a structure, since the timing of forming the test pattern and the timing of measuring the surface electric potential Vs can be adjusted on the surface of the photosensitive drum 4 corresponding to the circulating position of the intermediate transfer belt 15, the test pattern forming position and the surface electric potential Vs measuring position can be caused to correspond to the predetermined position of the circumferential surface of the belt-state transfer unit 14.

In such a manner, even though the transfer property of the intermediate transfer belt 15 is non-uniform in the circumferential surface direction, the formation of the test pattern and the measurement of the surface electric potential Vs are practiced for only one area of the circumferential surface. Consequently, the non-uniformity of the transfer property of the intermediate transfer belt does not exert any influence on the result of this measurement. Namely, in the case the formation of the test pattern and the measurement of the surface electric potential Vs are practiced from one time to several times, the intermediate transfer belt 15 is repeatedly circulated with a frequency corresponding to the above times, and further one test pattern is formed per one revolution of the intermediate transfer belt 15 and the surface electric potential Vs is measured once at the same time.

Moreover, in the case of causing the position of forming the test pattern and the position of measuring the surface electric potential Vs to correspond to one position of the intermediate transfer belt 15, when the transfer property on this position is abnormal, the transfer voltage Vt cannot be adjusted properly. Therefore, it is necessary to select a position where the transfer property thereof is at an average.

In the digital copying machine 1 as mentioned above, the transfer voltage Vt of the belt-state transfer unit 14 can be adjusted properly. However, since the transferring of the test pattern's toner image is practically done by the above-mentioned adjusting operation, a large amount of toner has to be consumed inevitably. In such a situation, a method of properly adjusting the transfer voltage Vt of the belt-state transfer unit 14 without consuming too much toner is explained hereinafter referring to a modification of the digital copying machine 1 of the embodiment.

In the digital copying machine 1 as described heretofore, a first electric potential sensor and a second electric potential sensor may be respectively disposed to oppose each other at an upstream side and at a downstream side of the position of the belt-state transfer unit 14 on the circumferential surface of the photosensitive drum 4. Under the condition of setting the transfer adjusting mode, the operation controlling unit operates the photosensitive drum 4, the charger 9, and the belt-state transfer unit 14 without operating the laser scanner 10 and the developing units 12. The operation controlling unit further changes in order the transfer voltage T of the belt-state transfer unit 14 brought in order into direct contact with the photosensitive drum 4. At this time, the surface electric potential Vo of the photosensitive drum 4 at the upstream side of the position of the belt-state transfer unit 14 is measured by the first electric potential sensor 5 in a first electric potential measuring unit, while the surface electric potential Vd of the photosensitive drum 4 at the downstream side of the position of the belt-state transfer unit 14 is measured by the second electric potential sensor in a second electric potential measuring unit. Thereafter, the condition detecting unit 55 detects the transfer voltage T on the condition that the variation "Vd−Vo" of the surface electric potential of the photosensitive drum 4 satisfies a predetermined tolerable area. The condition establishing unit 56 adjusts the transfer voltage Vt of the belt-state transfer unit 14 at the ordinary printing mode on the basis of the detected transfer voltage T.

Figure 10:
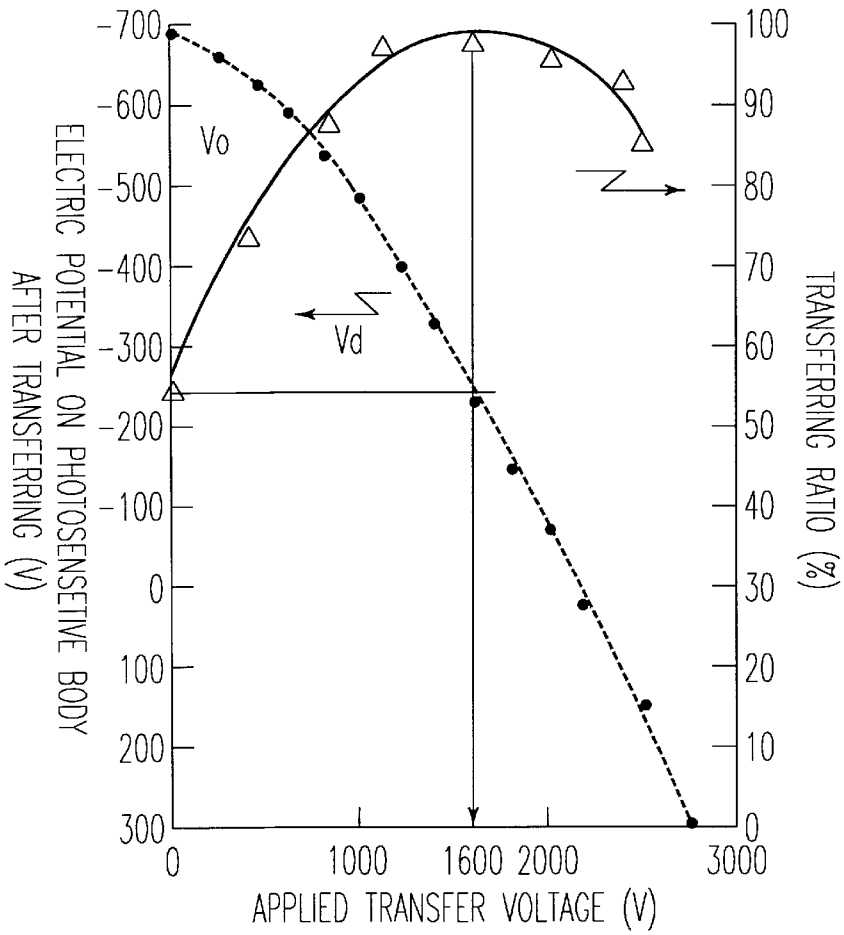
FIG. 10 is a graph showing a relationship of a transfer voltage of a belt-state transfer unit, a transfer rate thereof, and a surface electric potential of a photosensitive body, in a second modification of an embodiment of the present invention.

Even though the transfer voltage Vt of the belt-state transfer unit 14 is adjusted in such a manner as mentioned above, the voltage Vt can be adjusted properly. The reasons thereof are described in detail hereinafter. For instance, in a case that the transfer voltage Vt of the belt-state transfer unit 14 is lower than the proper value, the transfer rate is low and thereby the variation "Vd−Vo" of the surface electric potential on the photosensitive drum 4 is also low. When the transfer voltage is increased starting at such a condition, the transfer rate is increased corresponding thereto, and thereby the variation "Vd−Vo" of the surface a electric potential of the photosensitive drum 4 is also increased, as shown in FIG. 10. As mentioned before, when the transfer voltage exceeds the proper area and is further increased, the transfer rate is saturated and thereafter is decreased. However, even on such an occasion, the variation "Vd−Vo" of the surface electric potential of the photosensitive drum 4 is also increased.

However, since the transfer voltage on the condition that the variation "Vd−Vo" of the surface electric potential satisfies the predetermined tolerable area comes in the proper area, if the transfer voltage Vt is detected at the transfer adjusting mode and the transfer voltage is adjusted at the ordinary printing mode, the belt-state transfer unit 14 operates in accordance with the optimum transfer voltage at the ordinary printing mode subsequent thereto.

To state more concretely, when the above-mentioned processing operation at the transfer adjusting mode was practiced by using one newly manufactured digital copying machine 1, the transfer voltage Vt≈1600 V for obtaining the variation "Vd−Vo=450 V" of the surface electric potential of the photosensitive drum 4 could be detected, as shown in FIG. 10. On the basis of the above detected result, when 85% of 1600 V (1360 V) was set to the belt-state transfer unit 14 as the transfer voltage, the above digital copying machine 1 could preferably perform a copying operation from a halftone image to the large-black-area image.

However, when a running test was practiced by use of the above digital copying machine 1, a phenomenon of toner dispersion occurred on the halftone image at a time of copying about 5000 sheets of paper. In such a situation, when the processing operation was further practiced at the transfer adjusting mode, the transfer voltage Vt≈700 V for obtaining the variation "Vd−Vo=450 V" could be detected as shown in FIG. 6. In such a situation, when 85% of 700 V (595 V) was set to the belt-state transfer unit 14 as the transfer voltage, the above digital copying machine 1 could preferably perform the copying operation from the halftone image to the large-black-area image.

Namely, the above digital copying machine 1 can properly adjust the transfer voltage of the belt-state transfer unit 14 as mentioned heretofore, and the toner is not consumed too much at a time of performing such an adjusting operation. Moreover, in the above digital copying machine 1, it is possible to cause the positions for measuring the surface electric potentials Vd and Vo of the photosensitive drum 4 to correspond to the predetermined positions on the intermediate transfer belt 15 as mentioned before, and thereby it is further possible to eliminate an influence due to non-uniformity of the transfer property in the circumferential direction of the intermediate transfer belt 15.

Furthermore, if the measurement positions of the surface electric potentials Vd and Vo of the photosensitive drum 4 are caused to correspond to the predetermined positions of the intermediate transfer belt 15 in such a way as mentioned above, the non-uniformity of the transfer property in the circumferential surface direction does not exert an influence on the adjustment processing. However, it is impossible to prevent the phenomenon that the non-uniformity of the transfer property exerts an influence on the transfer efficiency at the time of copying. A method of solving such a problem of the non-uniformity of the transfer property in the circumferential surface direction of the intermediate transfer belt 15 is explained hereinafter as another modification of the digital copying machine 1.

In the digital copying machine 1 explained here, the electric potential sensor 5 measures the surface electric potential Vd of the photosensitive drum 4, and an electric potential memorizing unit memorizes the pattern of the surface electric potential Vd of the photosensitive drum 4 per each revolution of the belt-state transfer unit 14 on the basis of the circulating position detected by a position detecting unit. A condition creating unit creates the pattern of the transfer voltage Vt per each revolution of the belt-state transfer unit 14 on which the surface electric potential Vd of the photosensitive drum 4 becomes constant corresponding to the pattern thus memorized. The transfer voltage per one revolution of the belt-state transfer unit 14 at the ordinary printing mode corresponding to the pattern of the transfer voltage Vt is thus created.

Figure 11:
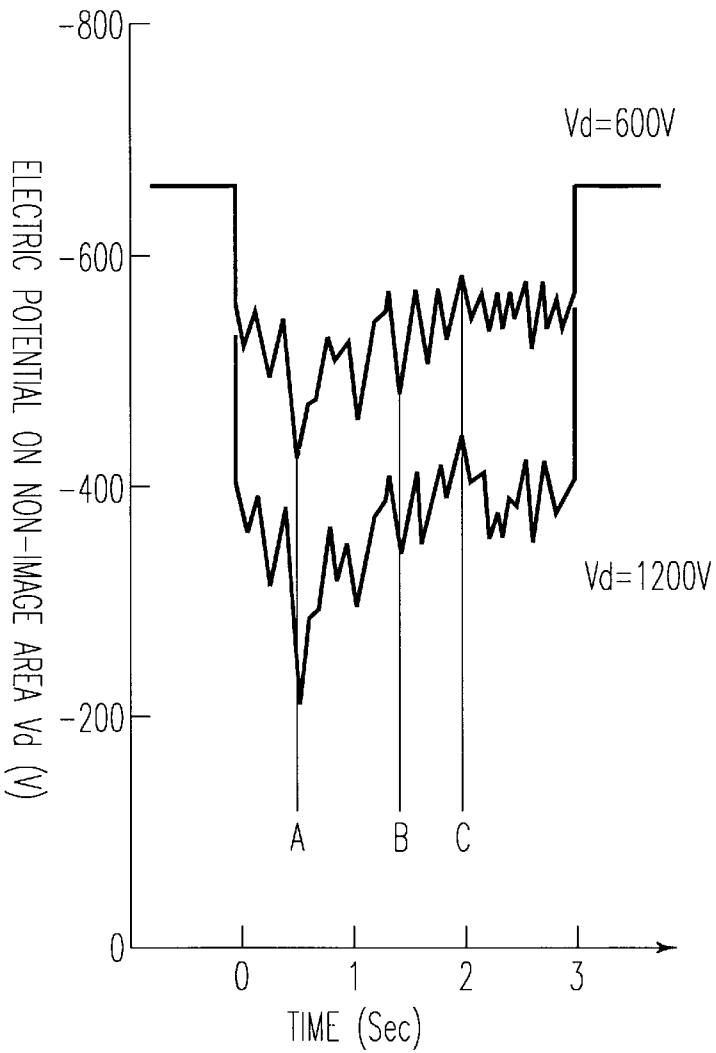
FIG. 11 is a graph showing a pattern of a surface voltage of a photosensitive body per one revolution of intermediate transfer belt.
Figure 12:
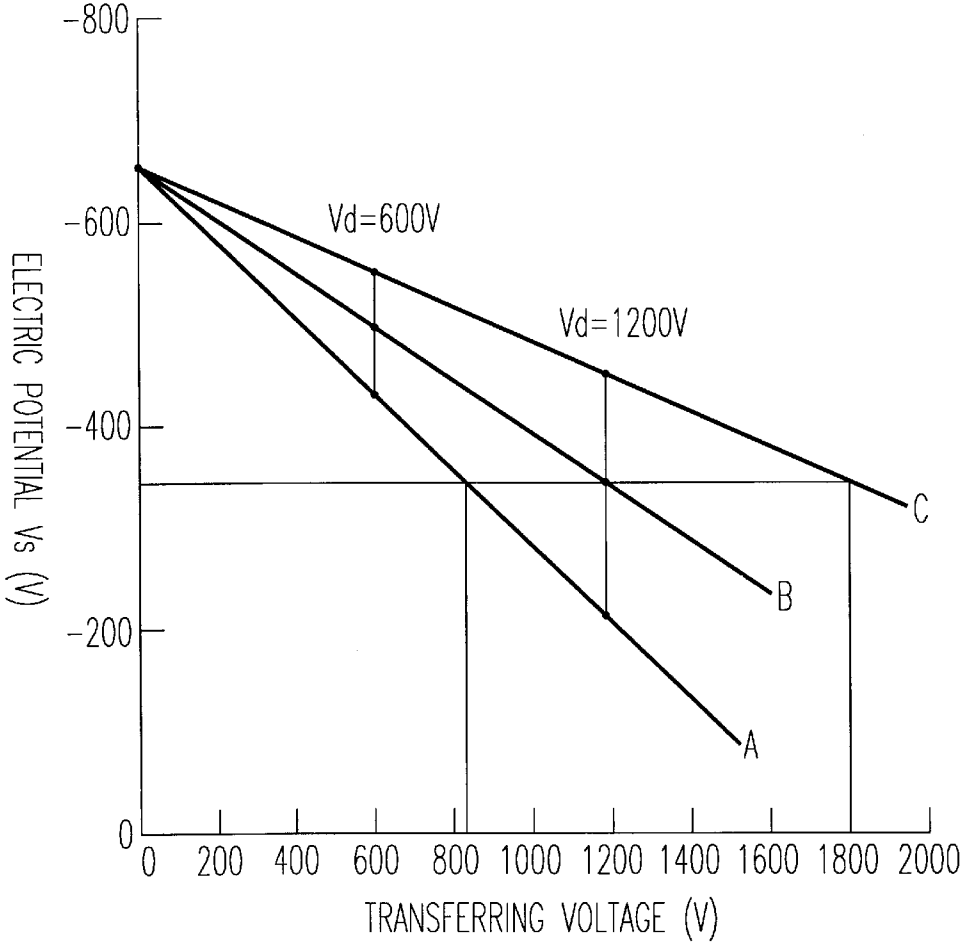
FIG. 12 is a graph showing a relationship between a transfer voltage of a belt-state transfer unit and the surface electric potential of a photosensitive body.

To state more concretely, the transfer voltage of the belt-state transfer unit 14 is firstly set to a low voltage of about 600 V, and as shown in FIG. 11, the pattern of the surface electric potential Vd of the photosensitive drum 4 per one revolution thereof is recorded. Next, the transfer voltage of the belt-state transfer unit 14 is set to a high voltage of about 1200 V, and the pattern of the surface electric potential Vd of the photosensitive drum 4 per one revolution thereof is recorded. If the relationship is generated between the transfer voltage on the predetermined position of the intermediate transfer belt 15 and the surface electric potential of the photosensitive drum 4 is obtained from the two patterns thus recorded, a linear relationship is generated therebetween starting at the surface electric potential before the transferring of the photosensitive drum 4 as shown in FIG. 12.

Figure 13:
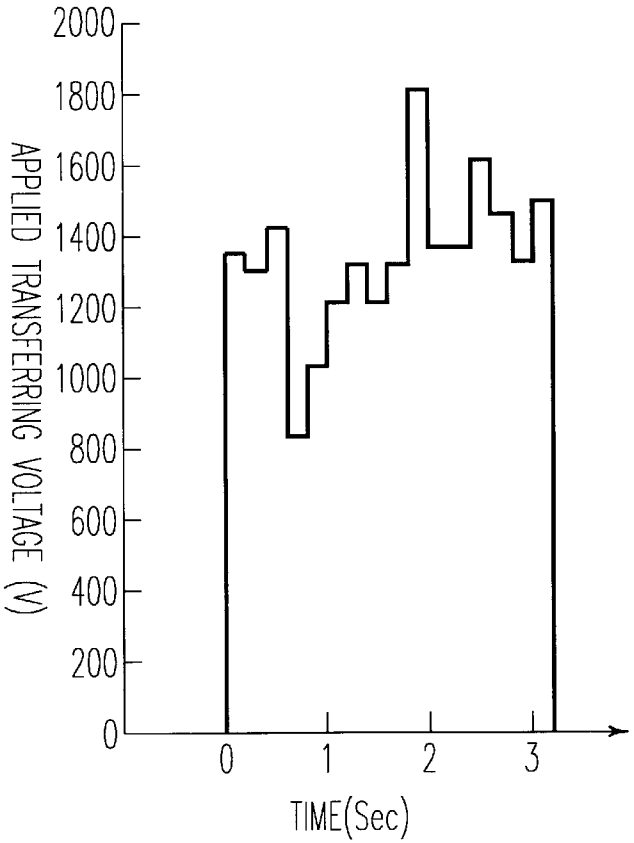
FIG. 13 is a graph showing a pattern of a transfer voltage per one revolution of an intermediate transfer belt for making uniform a surface electric potential of a photosensitive body.

For instance, if it has been made clear by the aforementioned method that the optimum transfer voltage is 1200 V on a position B of the intermediate transfer belt 15, the respective optimum transfer voltages 840 V and 1800 V on the other positions A and C can be also made clear from the above-mentioned relationship. If the optimum transfer voltage is calculated on the plural positions in the circumferential surface direction of the intermediate transfer belt 15 in such a way, since the above-mentioned optimum transfer voltage is generated as the pattern of the transfer voltage Vt per each revolution of the belt-state transfer unit 14 for making constant the surface electric potential Vd of the photosensitive drum 4 as shown in FIG. 13, the thus generated transfer voltage Vt of the pattern is set as the pattern of the transfer voltage per one revolution of the belt-state transfer unit 14 at the ordinary printing mode. In such a situation as mentioned heretofore, since the transfer voltage of the belt-state transfer unit 14 is properly adjusted in accordance with the established pattern, in the ordinary printing mode subsequent thereto, for instance, even though the transfer property of the intermediate transfer belt 15 becomes non-uniform in the circumferential surface direction due to a manufacturing error, etc., the belt-state transfer unit 14 can always demonstrate uniform transfer efficiency.

In conclusion, the advantageous functional effects for the respective inventions are described hereinafter.

In an image forming apparatus of the present invention, since a transfer condition of a transfer unit can be optimumly adjusted under a condition of establishing a transfer adjusting mode, an image can be formed with high image quality in an ordinary printing mode. Furthermore, since such an adjusting operation can be practiced at any time, even though environmental variations and/or time-elapsing variations may happen, the transfer condition can be always kept optimum.

In an image forming apparatus of the present invention, if a transfer property of the transfer body is non-uniform in a circumferential surface direction due to a manufacturing error, etc., the above matter does not exert any influence on an operation of adjusting the transfer condition. Therefore, the transfer condition can be properly adjusted.

In an image forming apparatus of the present invention, if a transfer condition of a transfer unit can be optimumly adjusted under a condition of establishing a transfer adjusting mode, an image can be formed with high image quality in an ordinary printing mode. Furthermore, since such an adjusting operation can be practiced at any time, even though the environmental variations and/or time-elapsing variations may happen, the transfer condition can be always kept optimum. Furthermore, since such an adjusting operation does not require transferring a toner image of a test pattern, the toner can be prevented from being consumed too much.

In an image forming apparatus of the present invention, even if a transfer property of a transfer body is non-uniform in a circumferential surface direction thereof due to a manufacturing error, etc., the above matter does not exert any influence on an operation of adjusting the transfer condition, and thus the transfer condition can be properly adjusted.

In an image forming apparatus of the present invention, even if a transfer property of a transfer body is non-uniform in a circumferential surface direction thereof due to a manufacturing error, etc., since a transfer efficiency of a transfer unit under a condition of establishing a transfer adjusting mode corresponding thereto becomes uniform, the image can be formed with high quality in an ordinary printing mode. Furthermore, since such an adjusting operation can be practiced at any time, even though environmental variations and/or time-elapsing variations may happen, the transfer condition can be always kept optimum.

In an image forming apparatus of the present invention, since a transfer property of a transfer belt may become uniform in a circumferential surface direction, a transfer efficiency can be uniformly generated by a transfer unit.

In the image forming apparatus of the present invention, since a transfer condition does not change at all at a halfway of a test pattern, a plurality of test patterns can be arranged at a shortest distance, and further an operation of adjusting a transfer condition can be completed promptly.

Obviously, numerous additional modifications and variations of the present invention are possible in light of the above teachings. It is therefore to be understood that within the scope of the appended claims, the invention may be practiced otherwise than as specifically described herein.

The present application is based on Japanese Priority document 08-206699, the contents of which are incorporated herein by reference.

What is claimed as new and desired to be secured by Letters Patent of the United States is:

1. An image forming apparatus comprising:

a photosensitive body having an endless circumferential surface capable of freely circulating;

a charger for charging said circumferential surface of said photosensitive body;

an exposing unit for forming an electrostatic latent image on said circumferential surface of said photosensitive body;

a developing unit for developing with toner said electrostatic latent image to form a developed toner image on said circumferential surface of said photosensitive body;

a transferring unit for electrostatically absorbing thereto said developed toner image from said circumferential surface of said photosensitive body in accordance with a transferring condition T;

an electric potential sensor for measuring a surface electric potential of said photosensitive body at a downstream position of said transferring unit;

mode changing over means for changeably setting at least an ordinary printing mode and a transfer adjusting mode as operational modes;

pattern forming means for forming a toner image of a test pattern on said circumferential surface of said photosensitive body by controlling said exposing unit in said transfer adjusting mode and by causing said charger and said developing unit to operate;

transfer controlling means for changing the transferring condition T of electrostatically absorbing said toner image of the test pattern formed on said circumferential surface of said photosensitive body by controlling said transferring unit;

electric potential measuring means for measuring a surface electric potential Vs at a position where said toner image of the test pattern on said photosensitive body is electrostatically absorbed;

condition detecting means for detecting the transferring condition T, wherein the transferring condition T is a rate $\Delta Vs/\Delta T$ of variation $\Delta Vs$ of said surface electric potential of said photosensitive body to a variation $\Delta T$ of the transferring condition T of said transferring unit; and condition setting means for adjusting the transferring condition T of said transferring unit in the ordinary printing mode based on said detected transferring condition T.

2. The image forming apparatus as defined in claim 1, further comprising:

a transferring body provided in said transferring unit for electrostatically absorbing toner from said circumferential surface of said photosensitive body capable of freely circulating;

position detecting means for detecting a circulating position of a circumferential surface of said transferring body; and timing controlling means for causing a formation position for forming said test pattern on the circumferential surface of said photosensitive body and a measuring position for measuring said surface electric potential thereof to correspond to predetermined position on said circumferential surface of said transferring body by controlling said pattern forming means and said electric potential measuring means based on said detected circulating position.

3. The image forming apparatus as defined in claim 2:

wherein said transferring body is composed of an endless transferring belt; and wherein said transferring belt is composed of plastic elements made by fusing and pushing out in an axis core direction perpendicular to a direction of the circumferential surface of the transferring body.

4. The image forming apparatus as defined in claim 1:

wherein a transferring body for electrostatically absorbing toner onto an endless circumferential surface thereof capable of freely circulating is provided in said transferring unit;

wherein said transferring body and said photosensitive body are brought into direct contact with each other in a circumferential surface direction over a predetermined nip length;

wherein said pattern forming means successively arranges plural test patterns on the circumferential surface of said photosensitive body through gaps longer than a nip length; and wherein said transfer controlling means varies the transferring condition T with a timing when said transferring body is brought into direct contact with a position of a respective gap between respective test patterns on the circumferential surface of said photosensitive body.

5. An image forming apparatus comprising:

a photosensitive body having an endless circumferential surface capable of freely circulating;

a charger charging said circumferential surface of said photosensitive body;

an exposing unit forming an electrostatic latent image on said circumferential surface of said photosensitive body;

a developing unit developing with toner said electrostatic latent image to form a developed toner image on said circumferential surface of said photosensitive body;

a transferring unit electrostatically absorbing said developed toner image on said circumferential surface of said photosensitive body in accordance with a transferring condition T;

a first electric potential sensor measuring a first surface electric potential Vo of said photosensitive body upstream from said transferring unit;

a second electric potential sensor measuring a second surface electric potential Vd of said photosensitive body downstream from said transferring unit:

mode changing over means for changeably setting at least an ordinary printing mode and a transfer adjusting mode as operational modes;

operation controlling means for causing said photosensitive body, said charger, and said transferring unit to operate under conditions of setting to said transfer adjusting mode;

transfer controlling means for changing the transferring condition T of said transferring unit;

condition detecting means for detecting the transferring condition T, wherein the transferring condition T is a variation value Vd−Vo of the surface electric potential of said photosensitive body satisfying a predetermined tolerable area; and condition setting means for adjusting the transferring condition T of said transferring unit in the ordinary printing mode on the basis of said detected transferring condition T.

6. The image forming apparatus as defined in claim 5, further comprising:

a transferring body provided in said transferring unit for electrostatically absorbing the toner from the endless circumferential surface of said photosensitive body capable of freely circulating;

position detecting means for detecting a circulating position of a circumferential surface of said transferring body; and timing controlling means for controlling operations of said first electric potential sensor and said second electric potential sensor based on the circulating position detected by said position detecting means and for causing a measuring position for the surface electric potential of said photosensitive body to correspond to predetermined positions on the circumferential surface of said transferring body.

7. The image forming apparatus as defined in claim 6:

wherein said transferring body is composed of an endless transferring belt; and wherein said transferring belt is composed of plastic elements made by fusing and pushing out in an axis core direction perpendicular to a direction of the circumferential surface of the transferring body.

8. An image forming apparatus comprising:

a photosensitive body having a circumferential surface capable of freely circulating;

a charger charging said circumferential surface of said photosensitive body;

an exposing unit forming an electrostatic latent image on said circumferential surface of said photosensitive body;

a developing unit developing with toner said electrostatic latent image to form a toner image on said circumferential surface of said photosensitive body;

a transferring unit electrostatically absorbing the toner image from the circumferential surface of said photosensitive body onto an endless circumferential surface of a transferring body capable of freely circulating;

an electric potential sensor measuring a surface electric potential of said photosensitive body downstream from said transferring unit;

mode changing over means for changeably setting at least an ordinary printing mode and a transfer adjusting mode as operational modes;

operation controlling means for causing said photosensitive body, said charger, and said transferring unit to operate under conditions of setting to said transfer adjusting mode;

electric potential measuring means for causing said electric potential sensor to measure a surface electric potential Vd of said photosensitive body downstream from said transferring unit;

position detecting means for detecting a circulating position on the circumferential surface of said transferring body;

electric potential memorizing means for memorizing a pattern of the surface electric potential Vd of said photosensitive body per one revolution of said transferring body based on the detected circulating position;

condition creating means for creating a pattern of a transferring condition T per one revolution of said transferring body to make constant the surface electric potential Vd of said photosensitive body corresponding to the memorized pattern; and condition setting means for adjusting the transferring condition T per one revolution of said transferring body at an ordinary printing mode corresponding to the pattern of the created transferring condition T.

9. The image forming apparatus as defined in claim 8:

wherein said transferring body is composed of an endless transferring belt; and wherein said transferring belt is composed of plastic elements made by fusing and pushing out in an axis core direction perpendicular to a direction of the circumferential surface of the transferring body.

10. A method of forming an image comprising steps of:

providing a photosensitive body having an endless circumferential surface capable of freely circulating;

charging said circumferential surface of said photosensitive body;

forming an electrostatic latent image on said circumferential surface of said photosensitive body by an exposing unit;

developing with toner said electrostatic latent image to form a developed toner image on said circumferential surface of said photosensitive body;

electrostatically absorbing said developed toner image on said circumferential surface of said photosensitive body in accordance with a transferring condition T set by a transferring unit at a transferring position;

measuring a surface electric potential of said photosensitive body downstream from said transferring position;

changeably setting at least an ordinary printing mode and a transfer adjusting mode as operational modes;

forming a toner image of a test pattern on said circumferential surface of said photosensitive body by controlling an operation of said exposing unit under a condition of setting said transfer adjusting mode;

changing the transferring condition T of electrostatically absorbing said toner image of the test pattern formed on said circumferential surface of said photosensitive body;

measuring a surface electric potential Vs at a position where said toner image of the test pattern on said photosensitive body is electrostatically absorbed;

detecting the transferring condition T, wherein the transferring condition T is a rate $\Delta Vs/\Delta T$ of variation $\Delta Vs$ of said surface electric potential of said photosensitive body to a variation $\Delta T$ of the transferring condition T; and adjusting the transferring condition T of said transferring unit in the ordinary printing mode based on said detected transferring condition T.

11. The method of forming an image as defined in claim 10, further comprising steps of:

providing a transferring body in said transferring unit for electrostatically absorbing toner from said endless circumferential surface of said photosensitive body capable of freely circulating;

detecting a circulating position on a circumferential surface of said transferring body;

causing a formation position for forming said test pattern on the surface of said photosensitive body and a measuring position for measuring said surface potential thereof to correspond to predetermined positions on said circumferential surface of said transferring body based on said detected circulating position.

12. The method of forming an image as defined in claim 11, wherein said transferring body is composed of an endless transferring belt; and wherein said transferring belt is composed of plastic elements made by fusing and pushing out in an axis core direction perpendicular to a direction of the circumferential surface of the transferring body.

13. The method of forming an image as defined in claim 10, further comprising steps of:

providing a transferring body in said transferring unit for electrostatically absorbing toner from said endless circumferential surface of said photosensitive body capable of freely rotating;

bringing said transferring body and said photosensitive body into direct contact with each other in a circumferential surface direction over a predetermined nip length;

successively arranging plural test patterns on the circumferential surface of said photosensitive body through gaps longer than a predetermined nip length; and varying the transferring condition T with a timing when said transferring body is brought into direct contact with a position of a respective gap between respective test patterns on the circumferential surface of said photosensitive body.

14. A method of forming an image comprising steps of:

providing a photosensitive body having an endless circumferential surface capable of freely circulating;

charging said circumferential surface of said photosensitive body;

forming an electrostatic latent image on said circumferential surface of said photosensitive body;

developing with toner said electrostatic latent image to form a developed toner image on said circumferential surface of said photosensitive body;

electrostatically absorbing said developed toner image on said circumferential surface of said photosensitive body in accordance with a transferring condition T set by a transfer unit at a transferred position;

measuring a first surface electric potential Vo of said photosensitive body upstream from said transferring position;

measuring a second surface electric potential Vd of said photosensitive body downstream from said transferring position;

changeably setting at least an ordinary printing mode and a transfer adjusting mode as operational modes;

changing the transferring condition T;

detecting the transferring condition T, wherein the transferring condition T is a variation value Vd−Vo of the surface electric potential of said photosensitive body satisfying a predetermined tolerable area; and adjusting the transferring condition T in the ordinary printing mode based on said detected transferring condition T.

15. The method of forming an image as defined in claim 14, further comprising steps of:

providing a transferring body for electrostatically absorbing toner from the endless circumferential surface of said photosensitive body capable of freely circulating;

detecting a circulating position on a circumferential surface of said transferring body; and controlling said first electric potential measuring step and said second electric potential measuring step based on the circulating position detected and thereby causing a measuring position for the surface electric potential of said photosensitive body to correspond to predetermined positions on the circumferential surface of said transferring body.

16. The method of forming an image as defined in claim 15:

wherein said transferring body is composed of an endless transferring belt; and wherein said transferring belt is composed of plastic elements made by fusing and pushing out in an axis core direction perpendicular to a direction of the circumferential surface of the transferring body.

17. A method of forming an image comprising steps of:

providing a photosensitive body having an endless circumferential surface capable of freely circulating;

charging said circumferential surface of said photosensitive body;

forming an electrostatic latent image on said circumferential surface of said photosensitive body;

developing with toner said electrostatic latent image to form a toner image on said circumferential surface of said photosensitive body;

electrostatically absorbing the toner image on the circumferential surface of said photosensitive body onto an endless circumferential surface of a transferring body capable of freely circulating at a transferring position;

measuring a surface electric potential Vd of said photosensitive body downstream from said transferring position;

changeably setting to at least an ordinary printing mode and a transfer adjusting mode as operational modes;

setting said transfer adjusting mode;

detecting a circulating position on the circumferential surface of said transferring body;

memorizing a pattern of the surface electric potential Vd of said photosensitive body per one revolution of said transferring body based on the detected circulating position;

creating a pattern of a transferring condition T per one revolution of said transferring body to make constant the surface electric potential Vd of said photosensitive body corresponding to the memorized pattern; and adjusting the transferring condition T per one revolution of said transferring body at an ordinary printing mode corresponding to the pattern of the created transferring condition T.

18. The method of forming an image as defined in claim 17:

wherein said transferring body is composed of an endless transferring belt; and wherein said transferring belt is composed of plastic elements made by fusing and pushing out in an axis core direction perpendicular to a direction of the circumferential surface of the transferring body.

* * * * *